United States Patent [19]

Hager

[11] 3,995,077

[45] Nov. 30, 1976

[54] PROCESS FOR TREATMENT OF WOOD

[75] Inventor: Bror Olof Hager, Djursholm, Sweden

[73] Assignee: Hager Aktiebolag, Taby, Sweden

[22] Filed: July 24, 1975

[21] Appl. No.: 598,819

[52] U.S. Cl. ..... 427/298; 34/9.5; 34/13.8; 34/16.5; 427/393

[51] Int. Cl.[2] ..... B05C 11/10; B27K 3/02

[58] Field of Search ..... 21/7; 34/9.5, 13.8, 34/16.5; 427/297, 298, 393, 397

[56] References Cited

UNITED STATES PATENTS

| | | | |
|---|---|---|---|
| 3,061,508 | 10/1962 | Morriss et al. | 422/298 |
| 3,560,251 | 2/1971 | Hager | 21/7 X |
| 3,889,020 | 6/1975 | Amandsen et al. | 427/298 X |

*Primary Examiner*—Michael R. Lusignan
*Attorney, Agent, or Firm*—Pierce, Scheffler & Parker

[57] ABSTRACT

Wood is impregnated with a solution of a preservative in a vaporizable, water-free, organic solvent and thereafter treated with a warm high-boiling oil composition under subatmospheric pressure conditions effecting evaporation of the solvent used in the impregnation step.

11 Claims, No Drawings

PROCESS FOR TREATMENT OF WOOD

FIELD OF THE INVENTION

This invention relates to the preservation of wood, and is concerned with the provision of a process wherein a wood preservative is administered by the aid of a non-aqueous treating solution.

DESCRIPTION OF THE PRIOR ART

My U.S. Pat. No. 3,560,251 describes a process for treating wood comprising impregnating the wood with an aqueous solution containing preserving substances, followed by a treatment in warm high-boiling oil under vacuum. The impregnation gives protection against wood destroyers such as decay and insects, and the oil treatment effects a fast, mild drying and a surface protection against moisture, cracking etc. If the oil has been pigmented, the treated wood is colored. The process thus gives a fast, mild and all-around treatment of the wood. The performance of the process is facilitated by the fact that the oil and the water (the preserving solution) are not miscible. In this way the evaporation of the water from the wood is made easier.

Experiments have, however, made clear that a similar process can, under certain conditions, be executed even if an organic solvent — soluble in the high boiling oil — is used as diluent for the preservative. Conditions under which such a modified process can be effected will here be described.

First the essential features of the new process are described. Then follows a detailed discussion with explanations of the different parts of the process.

SUMMARY OF THE INVENTION

The process of the present invention starts with an impregnation of the wood with a preserving agent dissolved in evaporable organic solvent. This is carried out in any suitable treating apparatus — as a rule an iron cylinder. Thereafter the solution is removed from the cylinder and a high boiling oil is introduced. The oil is kept warm at the same time as a subatmospheric pressure (partial vacuum) is maintained in the treating cylinder. Under these circumstances the solvent speedily evaporates (boils) from the wood. The vapor from the solvent is condensed (cooled) and recovered for further use. The warm oil is thereafter — still under maintained partial vacuum — removed from the treating cylinder, and the wood in the cylinder can be looked upon as being ready treated. From the introduced preserving agent the wood has obtained a protection against destructive organisms and further it has obtained a surface protection against air and moisture by reason of the oil introduced in the outer layers of the wood.

Now to the details of the different parts of the process.

DESCRIPTION OF THE PREFERRED EMBODIMENT

The perserving treatment preferably is carried out under pressure in an iron cylinder. For having so small a quantity of solvent as possible to evaporate from the wood during the following period, an "empty cell" treating method such as that of Rueping or Lowry is preferred. Hereby Swedish pine receives about 80–150 liters of solution per cubic meter of wood, instead of the 300 liters which would need to be introduced if "full cell" method of impregnation were used. All three named methods give good distribution of the preservatives in the wood. The amount of preservative introduced into the wood is the same and independent of the method used. If the selected method uses less solution, the solution is kept stronger to compensate for the smaller amount of solution absorbed.

By treatments based on organic solvents the empty cell method can be looked upon as being a necessity. an expensive solvent is used, and it is a problem to keep the consumption of it as low as possible. By conventional pressure treatment the solvent cannot be recovered. After the treatment when the solvents have fulfilled their task by distributing the preservative they evaporate from the wood and in this way are lost.

It may be observed that by the process according to the present invention — where the Rueping and/or Lowry method is recommended as a part of process — the reasons against the "full cell" alternative are not so strong as by conventional pressure treatments. By the present process the solvent is recovered; the problem is to make this recovery as simple as possible. The empty cell methods tend to solve this problem. As will be seen below, the cost for the recovery is not high.

These problems are diminished to a high degree when using water solutions where the cost for the solvent is not so high.

For having possibilities to accomplish the process with good result the solvent and the high boiling oil in which the wood is heated must have certain properties different from each other: above all their boiling points or boiling intervals must perform special demands.

For the solvent the following is valid.

The solvent must be one which is easy to evaporate. As a rule, however, too low boiling solvents ought not to be used owing to risks for fire, health and other inconveniences, risks for leachage, and other losses etc. Extremely evaporable solvents have been used by pressure treatment, but they have caused considerable difficulties. For obtaining rational working conditions the solvents ought to be in a liquid form and not have a too high steam pressure at ordinary temperatures. By boiling points under and around 125° Celsius they ought to be composed of or contain substances which are difficult to burn or have fire-retarding properties. The boiling point may on the other side not exceed about 200° C., otherwise the evaporation of the solvent from the wood — carried out with the aid of the hot, high boiling oil — will be difficult to fulfill. Preferably the boiling point may be around 150° C.

As solvents, mineral oils with a limited boiling range are used in the first place. Pure products such as toluene and xylene may be used but they are more expensive. Such pure products have the advantage of distilling (boiling) at an exact temperature; if they contain impurities they still distil within a very narrow temperature range. With such solvents it is easier to carry out the process with the best result and to recover the solvents most completely.

Solvents hard to burn as certain chlorinated products can be used with certain advantages. Such are for instance dichlorobenzene, dichlorobutane trichloropropane, tetrachloroethylene, tetrachloroethane and pentachloroethane. When using solvents of this kind lower boiling points can — as indicated above — be accepted, even such a low boiling product as trichloroethylene may be used. It seems best to use a mineral oil product and, when necessary, mix it with a fire-retardant chemical such as a chlorinated solvents, as a rule in an amount of from 10 to 20 per cent weight based on the total weight of the solvent.

A preserving agent can be used, for example pentatetra or trichlorophenol, nitrophenol, chloronaphtalene, cresol naphthol etc. but there also can be used tin compounds such as tributyltinoxide or organic oil-soluble copper-compounds. Fatty acids such as caprylic and capric acid, and their copper compounds, are very suitable.

In some cases these agents cannot be directly dissolved in the solvents. If so, the agents have to be dissolved or reacted with substances making the agents soluble in the solvent used. Often tall-oil or naphtenic acid is used for dissolving copper compounds or chlorophenol.

Such a solution is as said introduced into the wood preferably by the Rueping or Lowry method. Both methods are finished by a vacuum step. It is suitable to maintain this vacuum when introducing the high boiling oil in the cylinder. If the vacuum is broken it is desirable to let air enter into the wood for a while. The introduced high boiling oil can be forced into the evacuated wood in too high an extent by the air pressure. The treatment with the hot high boiling oil tends to evaporate the solvent from the wood and to give a surface treatment; a deeper treatment is not wanted as it would consume too much expensive oil. The vacuum may also be maintained because the following treatment is best fulfilled under vacuum.

The high boiling oil thus introduced into the cylinder may have the following properties.

The oil must have a boiling point definitely higher than that of the solvent. The two liquids can be mixed in each other and if the boiling points are not far enough from each other a mixture of them will boil over together — a fractioned distillation will take place. This can be — not theoretically — but practically avoided if the boiling points of the two liquids are far enough from each other. The boiling point for the oil has therefore to be at least around 250° C. But here also another viewpoint may be observed. A part of oil is as a rule intended to remain in the surface of the wood and give permanent protection. During the use of the wood the oil must not evaporate. If the oil has to give such a protection it must have a boiling point of at least 300° C.

Different kinds of high boiling oils can be used depending on the circumstances. It can be a non-drying oil such as paraffin oil, or less purified oils of this type, fatty oils etc. It can be a drying oil or a partly drying oil such as linseed oil, tall-oil, or an alkyde. It can also be a mixture of non-drying and drying oils.

If desired, a pigment can be introduced into the oils and if so the treated wood will be colored. Even other substances — for example, preservatives against blue stain and fire retardants such as tricresylphosphate and chloroparaffins — can be introduced. The preservatives normally present in the solvent can also be introduced into the oil as well as the preservatives which normally are introduced into the oil can be introduced into the solvent.

The composition of the oil or oil mixture is dependent of the use of the wood and of added substances. As an example, it may be said that the pigment dispersion as a rule will be more stable if aromatic substances are present in the oil. Drying oils may be present in the oil mixture if pigment is used. The drying degree of the oils may be limited if the oil shall be able to follow the movements (shrinkage and swelling) of the wood without cracking. As a rule a drying oil is present at least to some extent, but in the cases when nothing but a surface protection against air and moisture is needed a non-drying oil can be used exclusively.

As said above, the high boiling oil is introduced into the treating cylinder suitably with the vacuum maintained. The oil is now kept warm. The heating can be effected in different conventional ways, e.g., by heating pipes in the cylinder, or a mantle covering the under part of the cylinder through which a heating medium such as steam or hot liquid is passing. The heating temperature — the temperature of the oil — normally can vary between 60° and 110° C. preferably it is kept around 80°. The applied partial vacuum ought to be high; it is kept at a pressure of 200 mm Hg or below. At the beginning of the period lower temperature and/or lower vacuum may be used in order to retard the very fast evaporation of solvent during this part of the period.

When the solvent evaporates rapidly from the wood, it boils away owing to the vacuum. The wood thus will be "dried" free from solvent. Even if the same ideal distillation circumstances do not prevail as when a water solution is used in the impregnation, experiments have shown that the results are acceptable (i.e., good) and definitely better than expected. This depends in the main part on the earlier-discussed broad difference between the boiling points solvent and oils. Another essential fact is that the solvent has a low heat of vaporization; as a rule, it is at most only one-fifth of that of the water. This means faster distillation; low heat consumption; and a simple cooling by the later condensation and recovery.

As a rule, wood of 25 mm is thickness can be dried almost free from solvent in about 4 hours; for a thickness of 50 mm 5 to 6 hours are needed.

The fact that solvent and oil are soluble in each other and theoretically give a poorer position for the distillation of solvent from the wood is, thus, compensated in practice by proper selection of solvents and oil, and by use of a solvent that has a low vaporation heat; and by rational working conditions. In the following another advantage will be discussed.

The solvent can be distilled rather completely from the wood. During this distillation process some solvent will be dissolved in the oil. From the oil the solvent is successively distilled away. It takes some time before the oil is free from solvent — especially the last small contents. Therefore as a rule the process is carried out with some solvent left in the oil. This amount is rather low and constant — an equilibrium arises — if the process is effected in repeated cycles. With the boiling points intervals given above it is rather easy to distil the oil practically free from solvent at the end of the process.

As said before, the solvent is recovered and is best done by cooling. This is simple, as the vaporization heat is low. As the cooling medium water or even air can be used. The cooler preferably may be placed between the treating cylinder and the vacuum pump. In such a way the load on the pump will be low as it does not have to carry away vapors.

The recovery of the solvent is of course very important as the solvent is expensive. The solvent can be used a plurality of times in the form it is recovered. As a rule no specific dissolving agents are lost. When carrying out impregnation with a water solution the situation is in this respect different; here, the special dissolving agents for the preserving chemicals are not recovered. Such unrecovered dissolving agents can be ammonia, carbon dioxide or/and chromium compounds. Here we have a further advantage of the process according to the invention.

During the distillating period the warm oil will give the surface of the wood a thorough treatment. It may be observed that the oil is treating the wood during several hours at an elevated temperature; it may also be observed that all parts of the oil are made useful for the wood. The applied heat gives the oil a low viscosity during the treatment, as opposed to use of a diluent which later evaporates and is lost. The treatment is thus much more effective than ordinary painting, and furthermore it gives the wood surface at least 5 times as much oil as painting does.

When the process has been effected as described it is finished. This will be carried out so that the oil is pumped out of the cylinder and away from the wood. During this operation the selected partial vacuum has to be maintained otherwise the outer air pressure would force too much expensive oil into the wood.

As said before, the oil remaining in the surface of the wood constitutes a protection against air and moisture. In the case pigment has been introduced into the oil the wood will be colored. As a rule a net retention of oil of about 40 kg figured per cubic meter of wood is obtained in the cases boards of 25 mm thickness are treated. Thinner wood — with a larger surface area — will absorb more, and thicker less, figured per cubic meter.

After the wood has been taken of the cylinder it is ready treated and ready for use. If drying oils have been used some days of storing can be needed for solidifying the oils.

SPECIFIC EXAMPLE

Totally 4.3 cubic meters pine boards, about 4 meters in length and with a dimension of 25 × 100 millimeter where treated.

The treating solution was composed of a mineral oil boiling between 150° and 165° C. as solvent. As preservative pentachlorophenol was dissolved in the solvent with the help of some tall-oil to an amount of 3 per cent by weight.

The "empty cell" Lowry method was used for the treatment. The preserving solution accordingly was introduced into the wood by pressure, 8 kgs per square centimeter, during a time of 90 minutes. Then the solution was carried away, and a high vacuum was applied during 30 minutes under which period some of the preservative solution was driven out of the wood. By maintained vacuum a high boiling oil composition was introduced into the cylinder. It was composed of equal parts linseed oil and a high boiling oil of paraffin type. In the oil mixture organic, microlite, red pigments (Ciba) has been dispersed.

The treatment with the boiling oil composition started at 60° C. After 60 minutes the temperature had been elevated to the end temperature of 80°. The period lasted a total of 4 hours and 15 minutes. The vacuum was held around 100 mm Hg.

During the period a total of 650 liter of solvent evaporated. The same was condensed and recovered. The wood was then taken out of the cylinder: it was practically free of solvent.

It may be noted that after 2 hours distillation an amount of about 4 per cent solvent was estimated to be present in the high boiling oil.

The treated wood had a red color and a surface protection provided by the high boiling oil. After a couple of days the linseed oil had been hardened and the wood surface was "dry" and gave no "oil troubles" when the wood was handled.

I claim:

1. In a process for treatment of wood, involving the steps of impregnating the wood with a solution containing preservative in an evaporable solvent; thereafter treating the wood in a warm high boiling oil composition under vacuum so that the solvent evaporates from the wood; and thereafter removing the oil composition from the treating vessel under maintained vacuum, the improvement according to which i. the evaporable solvent is an organic solvent having a boiling point of below 200° C.;

ii. the high boiling oil composition has a boiling point of at least 250° C.;

iii. the high boiling oil composition is maintained at a temperature between 60° and 110° C. during the evaporating period.

2. The improved process according to claim 1 wherein the organic solvent has a boiling point of 75° to 125° C.

3. The improved process according to claim 1, wherein i. the organic solvent has a boiling point between 75° and 125° C.;

ii. the high boiling oil composition has a boiling point over 300° C.;

iii. the high boiling oil composition has a temperature of about 80° C. during the evaporation period.

4. The improved process according to claim 1 wherein the vacuum pressure is not higher than 200 mm Hg.

5. The improved process according to claim 1, wherein the vacuum pressure is about 100 mm Hg.

6. Process according claim 1, wherein the selected solvent consists of a mineral oil product.

7. Process according claim 1, wherein the selected solvent contains a fire-retarding product such as a chlorinated organic product.

8. Process according claim 1, wherein the preservative is a member of the group consisting of chlorophenol, fatty acid with 6–12 carbon atoms, a copper compound and a tin compound.

9. Process according claim 1, wherein the high boiling oil comprises a drying oil.

10. Process according claim 1, wherein the oil contains a fire-retarding product selected from the group consisting of tricresylphosphate and chlorinated naphthalene.

11. Process according claim 1, wherein the oil contains a finely dispersed coloring product.

* * * * *